United States Patent [19]

Choudhury et al.

[11] Patent Number: 4,726,840

[45] Date of Patent: Feb. 23, 1988

[54] METHOD FOR THE ELECTROSLAG REFINING OF METALS, ESPECIALLY THOSE HAVING ALLOY COMPONENTS WITH AN AFFINITY FOR OXYGEN

[75] Inventors: Alok Choudhury, Püttlingen; Felix Müller, Gelnhausen; Gerhard Brückmann, Asslar, all of Fed. Rep. of Germany

[73] Assignee: Leybold-Heraeus GmbH, Cologne, Fed. Rep. of Germany

[21] Appl. No.: 896,937

[22] Filed: Aug. 15, 1986

[30] Foreign Application Priority Data

Jun. 7, 1986 [DE] Fed. Rep. of Germany ..... 3619293

[51] Int. Cl.[4] ..... B22D 27/02

[52] U.S. Cl. ..... 75/10.24; 75/10.25; 75/10.26; 75/49

[58] Field of Search ..... 75/10.24, 10.25, 10.26, 75/49

[56] References Cited

U.S. PATENT DOCUMENTS 3,759,311 9/1973 Jackson ..... 75/10.24

3,868,987 3/1975 Galey ..... 75/10.24

*Primary Examiner*—Peter D. Rosenberg

*Attorney, Agent, or Firm*—Felfe & Lynch

[57] ABSTRACT

Method for the electroslag refining of metals of which at least 50 weight-percent are in the form of at least one current-carrying consumable electrode, especially one having alloy components with an affinity for oxygen, wherein the metals are remelted to an ingot through a molten bath of slag. To achieve the object of preventing oxidation, freckling, rings and white spots and at the same time produce a degassing, the following measures are undertaken: (a) the refining process is performed at a subatmospheric pressure, (b) the slag is an at least 80 weight-percent oxidic slag of oxides whose boiling points are above 2000° C., and (c) the slag is heated by means of alternating current.

7 Claims, No Drawings

METHOD FOR THE ELECTROSLAG REFINING OF METALS, ESPECIALLY THOSE HAVING ALLOY COMPONENTS WITH AN AFFINITY FOR OXYGEN

BACKGROUND OF THE INVENTION

The invention relates to a method for the electroslag refining of metals in which at least 50% of the metal is in the form of at least one current-carrying consumable electrode, especially one having alloy components with an affinity for oxygen, which is melted through a molten pool of slag to form an ingot.

In the electroslag refining process, the metal starting material is remelted through a liquid or molten slag layer to form an ingot or block on whose top surface a liquid zone or molten pool is maintained. The ingot can be held fixed (in an upright mold) or it can be drawn continuously downward (through a strand casting mold). The starting material can be added both in the form of a consumable electrode and in the form of lumps or particles. The melting and process heat is produced by the electrical resistance of the molten slag, the power being fed either through the consumable electrode or (in the case of particulate starting material) through a special permanent electrode. As a rule the ingot and/or the mold is the electrical counter-pole. It is known to perform the electroslag refining process by means of either direct current or alternating current.

DE-OS No. 14 83 646 discloses the performance of electroslag refining under subatmospheric pressure, i.e., under a pressure of less than 1 bar. In this case permanent electrodes are always provided for the power input.

For the production of castings to satisfy exacting requirements, especially from superalloys for rotors in aircraft engines, the customers require that the ingots be made by the known vacuum refining process (VAR), since refining under a vacuum results in relatively pure ingots having a very low gas content. Despite the fact that in the VAR process the ingots are normally free of macrosegregations due to controlled solidification, a number of typical segregation phenomena occur in the ingots, such as freckling, rings and white spots. While segregation phenomena such as the freckling and rings can be more or less overcome by careful adjustment of the melting parameters, the formation of white spots can occur no matter what the melting conditions are. Recently performed studies have shown that the formation of white spots is not the result of irregular solidification at the solidification front. It can be assumed that the components of the white spots are the following:

- skeletons of dendrites which drop from the molten consumable electrode during the melting,
- particles which drop down from the so-called "crown" at the upper edge of the ingot (the crown is a thin, sharp edge above the lake due to condensation or solidification of vapors and splashes,
- particles that come loose from the solidifying edge of the molten pool.

Another source of the white spots can, according to the inventor's own experience, consist of particles which can originate from the cast electrode when the latter consists of a superalloy, which very often splits along the radial crystals. It is therefore very difficult, if not quite impossible, to prevent these flaws in a VAR ingot.

In the electroslag refining process described in the beginning, the refining is performed under a superheated molten slag bath whose temperature is usually more than 300° C. above the liquidus temperature of the superalloy. The dendrite skeleton or the particles that break out of the electrode necessarily drop through the superheated slag and consequently have enough time to melt before they reach the pool. Also, in the electroslag process no crown forms at the top edge of the ingot. Consequently, the electroslag refining process does not lead to the formation of white spots.

Although the ingots produced by the electroslag process are at least as good as those obtained by the VAR process, the purchasers of superalloys regularly call for the use of the VAR process for the production of rotors for aircraft engines. The reason for this is to be seen in the fact that, in the conventional electroslag processes not only does no degassing of the material occur, but in certain cases an additional absorption of gas is to be feared, and hydrogen and nitrogen are the most dangerous gases.

Another very important danger consists in the formation of oxides and oxidic inclusions by the oxidation of the metal, especially of the alloy components which have an affinity for the oxygen in the ambient air. These alloy components with an affinity for oxygen are the elements aluminum, boron, titanium, zirconium and others. The oxidation of such alloy components then results in a defect.

The invention is therefore addressed to the problem of devising a process of the kind described in the beginning, in which oxidation is prevented, degassing takes place, and neither freckles nor ring patterns nor white spots occur. It is important to note that all aspects of the problem in question are solved simultaneously.

SUMMARY OF THE INVENTION

The solution of the stated problem is accomplished in accordance with the invention, in the process described in the beginning, by the combination of the following features:

(a) the refining process is performed under less than atmospheric pressure, (b) an at least 80 weight-percent oxidic slag is used, composed of oxides whose boiling points are higher than 2000° C., and (c) the slag is heated by alternating current.

If a protective gas atmosphere of inert or noble gas is used, the process can be performed at a pressure of no more than 900 mbar. If a vacuum is used, it is especially desirable to perform it in a pressure range between 200 and 0.01 mbar. In all cases a sufficient degassing of the melt takes place, and any oxidation of the electrode metal and of the alloy components is effectively prevented without the need to forego the advantages of the electroslag refining process as regards a good ingot surface, metallurgical working and the avoidance of white spots.

At the same time the composition of the slag is especially important. For example, it is known from the literature that gaseous fluorine compounds continually escape from slag mixtures containing large percentages of fluorine, on account of the chemical reactions of the fluorine compound with oxidic components in the slag. If such a slag of high fluoride content should be used in a vacuum, the reaction would shift towards the formation of additional volatile fluorides on account of the reduction of the partial pressure, so that the process would be difficult to control.

If, in accordance with the invention, a slag is used having a content of at least 80 weight-percent of oxidic components whose boiling points are higher than 2000° C., the slag composition will remain stable. Such slags are, especially, pure oxide systems, such as for example those of calcium oxide, aluminum oxide and magnesium oxide. It is especially advantageous to use a mixture of 48% each of calcium oxide and aluminum oxide, plus 4% of magnesium oxide.

The advantages of the method according to the invention can be stated as follows:

1. the use of alternating current for the better control of the desired metallurgical reactions and for the prevention of rectified magnetic fields which would favor the formation of freckles in the remelted ingot, 2. the use of the vacuum to eliminate the effects of hydrogen and nitrogen and to prevent oxidation of slag and metal, 3. the use of an oxidic, reactive slag for the attainment of a better degree of purity than in the VAR process, and 4. the prevention of white spots.

EXAMPLE

A consumable electrode of Inconel 718, a nickel-base alloy with high contents of titanium and aluminum, and with a length of 500 mm and a diameter of 90 mm, was remelted to form an ingot in a water-cooled upright mold with an inside diameter of 150 mm. The level of the molten slag above the ingot was 70 mm. The slag consisted of 48 weight-percent each of calcium oxide and aluminum oxide and 4 weight-percent of magnesium oxide. The electrode was operated at a voltage of 35 V and a current of 2300 A. After a refining period of 15 minutes under a vacuum of 0.5 mbar, all but a stub of the electrode had melted away. The ingot removed from the mold after cooling had no "crown." Polished sections showed that the block was free of freckles, white spots and rings over its entire length and its entire diameter. The alloy composition was very much the same as that of the electrode, i.e., no burn-up of aluminum and titanium was observed.

We claim:

1. Method for electroslag refining of metals wherein at least 50 percent by weight of the metal to be refined is in the form of at least one current-carrying consumable electrode, said method comprising remelting said metal to an ingot through a molten slag bath, wherein said slag contains at least 80 weight percent of oxides with boiling points about 2000° C., heating said slag by an alternating current means, said refining taking place at subatmospheric pressure to form refined metal, and forming an ingot or block of said refined metal.

2. Method according to claim 1, characterized in that the vacuum pressure is from 200 to 0.01 mbar.

3. Method according to claim 1, characterized in that the refining process is performed under an inert gas atmosphere at a pressure up to 900 mbar.

4. Method according to claim 1, characterized in that the frequency of the alternating current is between 1 and 100 Hz.

5. Method of claim 1, wherein said electrode contains an alloy component with oxygen affinity.

6. Method of claim 1, wherein said slag contains calcium oxide, aluminum oxide, and magnesium oxide.

7. Method of claim 6, wherein said slag is 48 percent calcium oxide, 48 percent aluminum oxide, and 4 percent magnesium oxide.

* * * * *